US009263006B2

(12) United States Patent
Khotinsky

(10) Patent No.: US 9,263,006 B2
(45) Date of Patent: Feb. 16, 2016

(54) NON-ELECTRICAL DEVICES AND METHODS FOR PRODUCING WAH-WAH AND OTHER EFFECTS WITH STRINGED INSTRUMENTS

(71) Applicant: Igor Khotinsky, Hadera (IL)

(72) Inventor: Igor Khotinsky, Hadera (IL)

( * ) Notice: Subject to any disclaimer, the term of this patent is extended or adjusted under 35 U.S.C. 154(b) by 41 days.

(21) Appl. No.: 14/322,022

(22) Filed: Jul. 2, 2014

(65) Prior Publication Data

US 2015/0007706 A1 Jan. 8, 2015

Related U.S. Application Data

(60) Provisional application No. 61/842,909, filed on Jul. 3, 2013.

(51) Int. Cl.

| | |
|---|---|
| ***G10D 3/00*** | (2006.01) |
| ***G10D 9/00*** | (2006.01) |
| ***G10D 3/16*** | (2006.01) |

(52) U.S. Cl.

CPC ..... *G10D 3/163* (2013.01)

(58) Field of Classification Search

USPC ..... 84/320

See application file for complete search history.

(56) References Cited

U.S. PATENT DOCUMENTS

| | | | | |
|---|---|---|---|---|
| 3,656,187 | A * | 4/1972 | Katz | A61F 2/588 623/65 |
| 4,817,488 | A * | 4/1989 | de los Santos | G10D 3/00 84/319 |
| 4,982,641 | A * | 1/1991 | Duhart | G10D 3/163 224/267 |
| 6,297,435 | B1 * | 10/2001 | Gutowski | G10D 3/00 84/307 |
| 6,903,256 | B2 * | 6/2005 | Pittman | G10D 3/163 84/320 |
| 7,923,616 | B2 * | 4/2011 | Hamilton | G10D 3/163 84/267 |

* cited by examiner

*Primary Examiner* — Christopher Uhlir

(74) *Attorney, Agent, or Firm* — Tillman Wright, PLLC; James D. Wright; David R. Higgins

(57) ABSTRACT

A non-electrical stringed instrument sound effects device includes a crosspiece, having a string interface, and a strapping system that is configured to removably fasten the crosspiece, including the string interface, around a plucking or strumming hand of a player of the stringed musical instrument. A method of creating a sound effect using the device includes attaching the device to a plucking or strumming hand of a player of a stringed musical instrument such that the strapping system extends around the hand and the crosspiece is disposed adjacent the outside of the hand, positioning the hand in a conventional plucking or strumming position such that the string interface of the crosspiece extends across at least one of the strings, and manipulating the string interface of the crosspiece against the strings while plucking or strumming to achieve a desired sound effect without use of electrical power.

31 Claims, 13 Drawing Sheets

NON-ELECTRICAL DEVICES AND METHODS FOR PRODUCING WAH-WAH AND OTHER EFFECTS WITH STRINGED INSTRUMENTS

CROSS-REFERENCE TO RELATED APPLICATION

The present application is a U.S. nonprovisional patent application of, and claims priority under 35 U.S.C. §119(e) to, U.S. provisional patent application Ser. No. 61/842,909, filed Jul. 3, 2013, which provisional patent application is incorporated by reference herein.

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

BACKGROUND OF THE PRESENT INVENTION

1. Field of the Present Invention

The present invention relates generally to stringed musical instruments and in particular to non-electrical devices and methods for producing sound effects on stringed instruments.

2. Background

Throughout history musicians have utilized special effects to dynamically alter the sound of an instrument creating unique musical notes and listening environments. For example, electric guitars are often used in conjunction with foot effects pedals (sometimes called "stomp boxes"), which the guitarist presses with his or her foot to change the characteristics of the sounds produced by the guitar. Tremolo, delay, echo, distortion, fuzz, overdrive, and wah-wah are a few examples of the different sound effects, which may be applied by such an effects pedal or unit. In addition to electric guitars, effects pedals and units may also be employed by other types of musical instruments connected to an amplifier, such as acoustic guitars, bass guitars, pianos, keyboards, pipe organs, drums, harps, and the like.

One particularly recognizable musical effect is the "wah-wah effect" that is typically created with a wah-wah pedal on an electrical guitar. The wah-wah effect is a type of spectral glide, which is a music-composition concept, consisting of a modification of the vowel quality of a musical tone. The wah-wah effect became wildly popular in the 1960s and 1970s by such players as Jimmy Hendrix and Eric Clapton. Currently, the wah-wah effect is generated by musicians through electrical signal processing devices often controlled by a foot pedal thus requiring the use of electrical instruments or the connection of a musical instrument to an electric amplifier. This setup requires musicians to purchase and travel with additional equipment, which is both expensive and burdensome. A related effect is a "delay" effect, which has similar problems.

There is therefore a need in the field for non-electrical devices and methods capable of generating wah-wah, delay, and other effects for use with stringed instruments such as the acoustic guitar

SUMMARY OF THE PRESENT INVENTION

Broadly defined, the present invention according to one aspect is a non-electrical stringed instrument sound effects device, including: a crosspiece, including a string interface, that is configured to be placed against one or more strings of a stringed musical instrument; and a strapping system that is configured to removably fasten the crosspiece, including the string interface, around all or a portion of a plucking or strumming hand of a player of the stringed musical instrument.

In a feature of this aspect, the non-electrical stringed instrument sound effects device further includes a spacer which, in conjunction with the strapping system, is configured to displace the crosspiece away from the plucking or strumming hand of the player. In further features, the spacer, in conjunction with the strapping system, is configured to position the crosspiece such that a first end of the crosspiece is adjacent the wrist of the plucking or strumming hand of the player and a second end of the crosspiece is displaced away from the outside of the palm of the plucking or strumming hand of the player such that an acute angle is formed between the orientation of the crosspiece and a line defined by the outside of the palm of the plucking or strumming hand of the player; the strapping system includes a support frame, and the spacer is carried by the support frame; the support frame has a shape arranged to mold to the palm of the plucking or strumming hand of the player; a chamber is at least partially defined by the string interface; the spacer includes a first portion and a second portion, wherein the second portion is adjustable relative to the first portion, wherein the first portion is connected to the strapping system, and wherein the crosspiece is connected to the second portion such that the crosspiece may be adjusted relative to the first portion of the spacer and thus relative to the strapping system; and/or the second portion of the spacer is rotatable relative to the first portion of the spacer via a ball and socket joint.

In another feature of this aspect, the crosspiece further includes a base member that supports the string interface.

In another feature of this aspect, the strapping system includes a first portion configured to extend around at least a portion of the wrist of the plucking or strumming hand of the player and a second portion configured to extend across at least a portion of the palm of the plucking or strumming hand of the player. In a further feature, the first portion of the strapping system is a first adjustable strap and the second portion of the strapping system is a second adjustable strap.

In another feature of this aspect, the string interface is made from an arched or otherwise curved length of hard material. In further features, the arched or otherwise curved shape of the string interface at least partially defines a chamber; the string interface is made from a cylindrical length of hard material; and/or the crosspiece is connected at one end thereof to the spacer.

In another feature of this aspect, the string instrument sound effects device further includes a noise reduction or prevention device that removably covers bridge pins of the stringed musical instrument. In a further feature, noise reduction or prevention device is a length of foam that includes slots on its underside to cover and wrap the bridge pins.

Broadly defined, the present invention according to another aspect is a method of creating a sound effect while plucking or strumming a stringed musical instrument, including: providing a non-electrical sound effects device, the device including a crosspiece and a strapping system, the crosspiece having a string interface; attaching the sound effects device to a plucking or strumming hand of a player of a stringed musical instrument such that the strapping system extends around all or a portion of the plucking or strumming hand and the crosspiece is disposed adjacent the outside of the plucking or strumming hand; by the player, positioning the plucking or strumming hand in a conventional playing position adjacent strings of the stringed musical instrument such that the string interface of the crosspiece extends across at least one of the strings; and during an action, by the player, of plucking or strumming the at least one string, manipulating the string interface of the crosspiece, by the player, against the at least one string to achieve a desired sound effect without use of electrical power.

In a feature of this aspect, the device further includes a spacer, wherein the step of attaching the sound effects device includes attaching the sound effects device to the plucking or strumming hand of the player such that the spacer displaces the crosspiece away from the plucking or strumming hand. In a further feature, the step of attaching the sound effects device includes attaching the sound effects device to the plucking or strumming hand of the player such that a first end of the crosspiece is adjacent the wrist of the plucking or strumming hand of the player and a second end of the crosspiece is displaced away from the outside of the palm of the plucking or strumming hand of the player such that an acute angle is formed between the orientation of the crosspiece and a line defined by the outside of the palm of the plucking or strumming hand of the player.

In another feature of this aspect, the strapping system includes a first portion and a second portion, and the step of attaching the sound effects device includes extending the first portion around at least a portion of the wrist of the plucking or strumming hand of the player and extending the second portion across at least a portion of the palm of the plucking or strumming hand of the player. In a further feature, the first portion of the strapping system is a first adjustable strap and the second portion of the strapping system is a second adjustable strap.

In another feature of this aspect, the string interface is made from an arched or otherwise curved length of hard material. In further features, the arched or otherwise curved shape of the string interface at least partially defines a chamber; and/or the string interface is made from a cylindrical length of hard material.

In another feature of this aspect, the step of positioning the plucking or strumming hand includes positioning the plucking or strumming hand such that the string interface of the crosspiece extends across at least one of the strings adjacent a bridge of the stringed musical instrument.

In another feature of this aspect, the step of manipulating the string interface of the crosspiece, by the player, includes contacting the at least one string while simultaneously plucking or strumming the at least one string.

In another feature of this aspect, the step of manipulating the string interface of the crosspiece, by the player, includes contacting the at least one string non-simultaneously with, but shortly after, plucking or strumming the at least one string.

In another feature of this aspect, the step of manipulating the string interface of the crosspiece, by the player, includes rubbing or sliding the string interface against or along the at least one string.

In another feature of this aspect, the step of manipulating the string interface of the crosspiece, by the player, includes creating a wah-wah or delay sound effect.

Broadly defined, the present invention according to another aspect is a musical instrument, having a non-electrical stringed instrument sound effects device, including: a conventional stringed instrument, held by a player such that a first hand, defining a picking or strumming hand, is positioned adjacent a soundboard of the stringed instrument and a second hand, defining a tuning hand, is positioned adjacent a neck of the stringed instrument; and a non-electrical sound effects device attached to the picking or strumming hand of the player, the device including a crosspiece, with a string interface that at least partially defines a chamber, that is placed against one or more strings of the stringed instrument, a spacer that positions the crosspiece away from the outside of the palm of the plucking or strumming hand, and a strapping system that holds the crosspiece and spacer on the picking or strumming hand.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Further features, embodiments, and advantages of the present invention will become apparent from the following detailed description with reference to the drawings, wherein.

DETAILED DESCRIPTION

Figure 1:
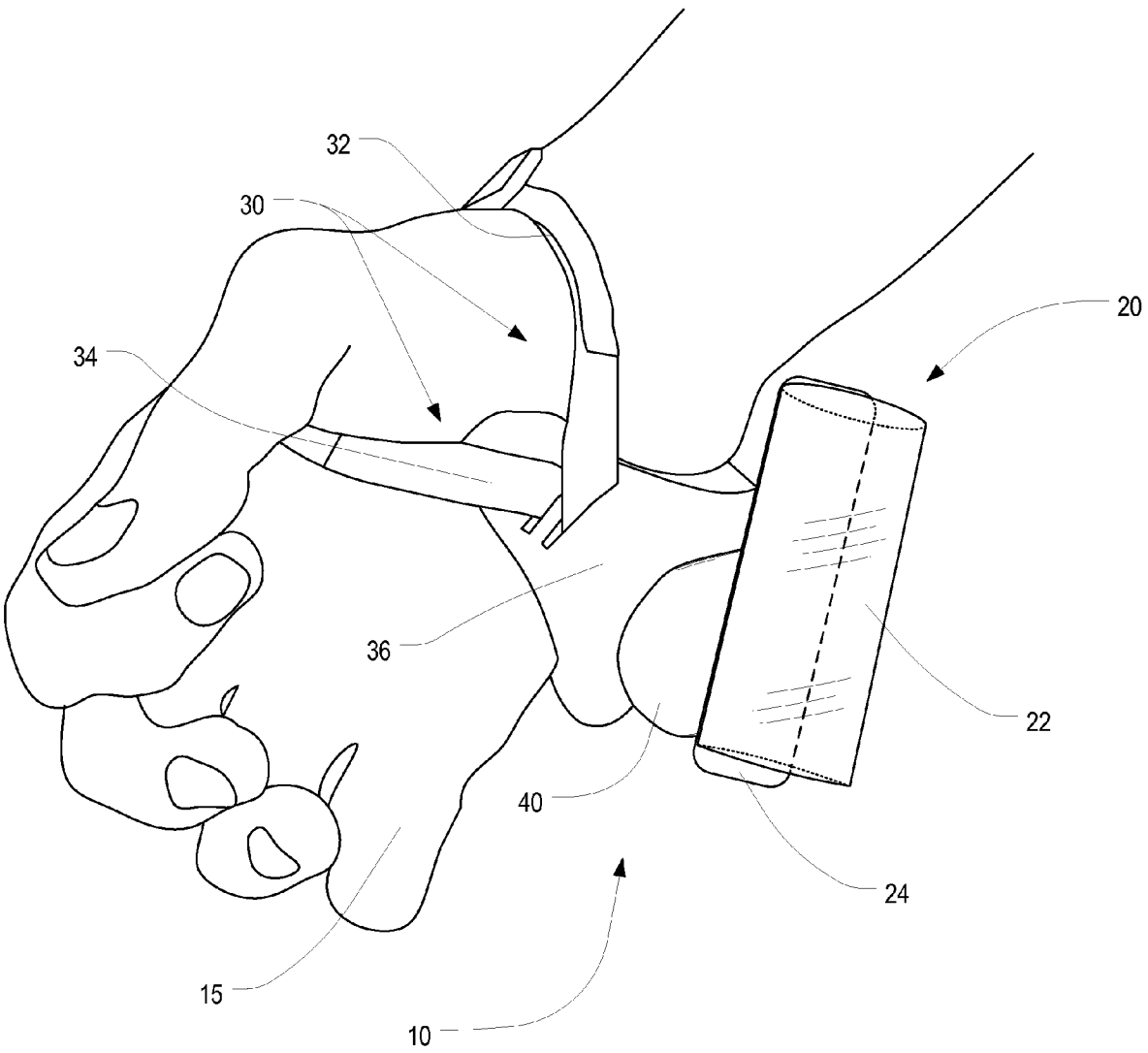
FIG. 1 is a front perspective view of a stringed instrument effects device in accordance with one or more preferred embodiments of the present invention.

As a preliminary matter, it will readily be understood by one having ordinary skill in the relevant art ("Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. As should be understood, any embodiment may incorporate only one or a plurality of the above-disclosed aspects of the invention and may further incorporate only one or a plurality of the above-disclosed features. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Regarding applicability of 35 U.S.C. §112, ¶6, no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers," "a picnic basket having crackers without cheese," and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

As used herein, the term "stringed instrument" or "stringed musical instrument" generally refers to any musical instrument that uses vibrating strings to produce a desired sound. Some non-limiting examples of stringed instruments include guitars, sitars, rababs, violins, violas, cellos, double (upright) basses, banjos, mandolins, ukuleles, bouzoukis, and harps. In some embodiments and in various examples provided herein, a stringed instrument is a non-electrical instrument such as an acoustic guitar. In some other unillustrated embodiments, the stringed instrument may be an electrical stringed instrument such as an electric guitar.

As used herein, the term "non-electrical" shall generally mean a type of musical effect device that does not need an electrical signal or electric power to generate a desired musical effect.

As used herein, the term "picking hand" shall generally mean the hand of a person plucking, picking, or strumming strings on a stringed musical instrument to generate sounds. In most examples, the player's picking hand is the one closest to the bridge of the stringed instrument.

As used herein the term "bridge" shall generally mean an upright piece of wood or other material used to raise the strings of a stringed instrument above the instrument's sound board.

Referring now to the drawings, in which like numerals represent like components throughout the several views, one or more preferred embodiments of the present invention are next described. The following description of one or more preferred embodiment(s) is merely exemplary in nature and is in no way intended to limit the invention, its application, or uses.

Figure 2:
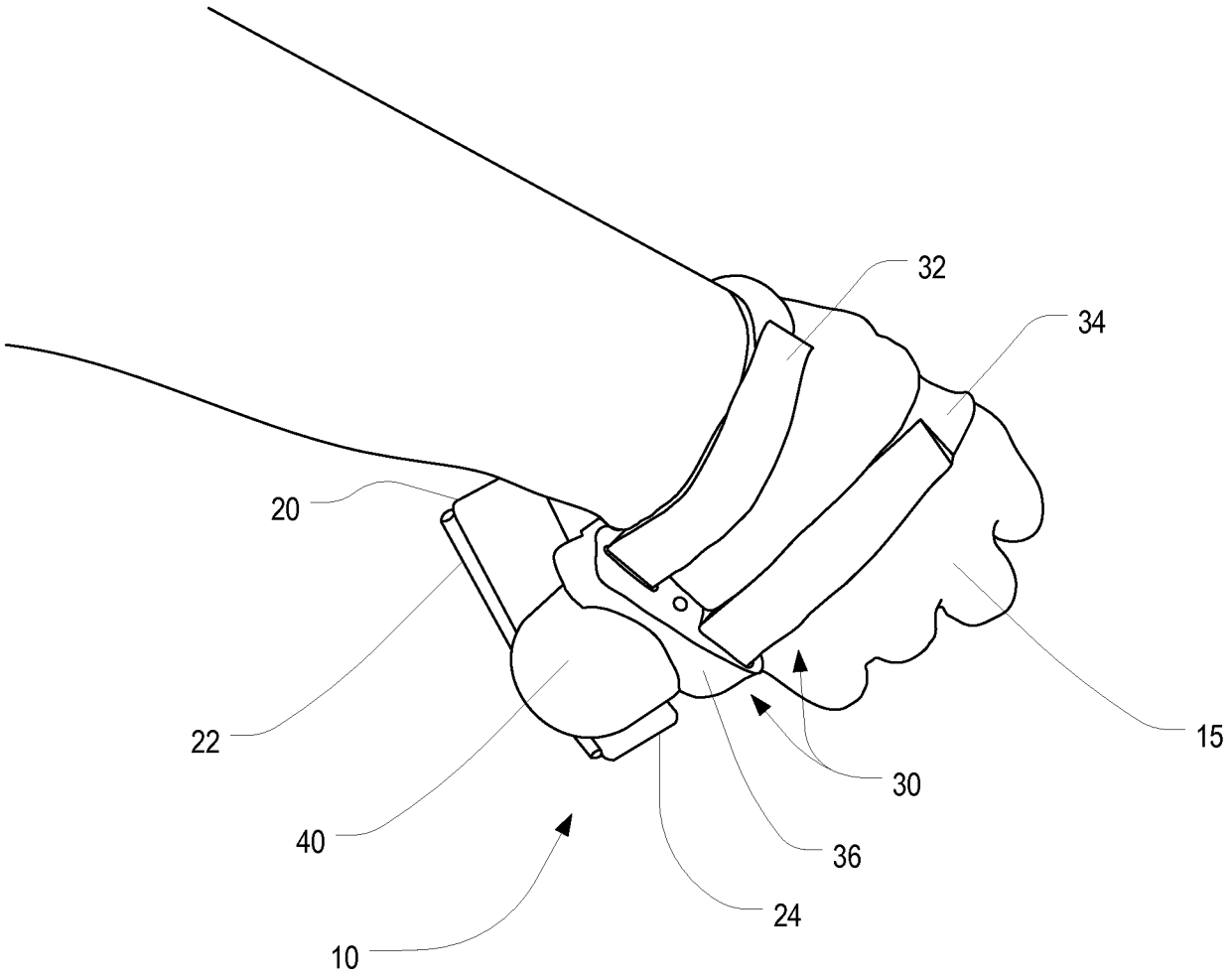
FIG. 2 is a back perspective view of the stringed instrument effects device of FIG. 1.

FIGS. 1 and 2 are a front perspective view and a back perspective view, respectively, of a stringed instrument effects device 10 in accordance with one or more preferred embodiments of the present invention. As shown in FIG. 1, the stringed instrument effects device 10 includes a cross-piece 20, a strapping system 30, and a spacer 40. The cross-piece 20 has a string interface 22 and a base member 24. The base member 24 connects the string interface 22 to a spacer 40.

The string interface 22 may be implemented in a variety of ways, but preferably includes a hard elongated surface that may be placed across at least some of the strings of the stringed instrument with which it is used. The string interface 22 in FIG. 1 is made from glass and is in the shape of a hollow cylindrical tube, defining a chamber 25, which may provide improved resonance characteristics, but in other preferred embodiments, the string interface 22 may be made from other rigid materials such as plastic, metal, wood, or any suitable material. In some preferred embodiments, the string interface 22 is made or adapted from a guitar "slide" or "steel," which is a hollow tube, bar, or other structure made from metal, glass or other materials and used to alter the pitch of a guitar when placed on the strings over the fret area of the guitar. In various embodiments, the string interface 22 is between 1.5 and 3.5 inches in length and 0.5 to 3.0 inches in diameter. In at least one preferred embodiment, the string interface 22 is approximately 2 inches in length and approximately 1 inch in diameter.

The string interface 22 is carried on the base member 24, which in turn is mounted on the spacer 40. As more fully described elsewhere herein, the spacer 40 is used to provide a desired spacing and orientation of the string interface 22 relative to the hand 15 so that the string interface 22 may be comfortably and conveniently be applied to the strings of the instrument. However, in some embodiments, the spacer may be omitted. In the embodiment of FIGS. 1 and 2, the base member 24 is produced from a length of rubber and the string interface 22 is connected to the piece of rubber using an adhesive. In various embodiments, the base member 24 is between 1.5 and 3.5 inches in length. In at least one preferred embodiment, the base member 24 is approximately 2 inches in length. In other preferred embodiments of the device, the string interface 22 may be connected by screws, nails, or, by other means such as threading straps through an eye or opening within the crosspiece, described hereinbelow.

The strapping system 30 likewise may be implemented in a variety of ways, but preferably includes a pair of straps 32,34 and a support frame 36. As shown in FIGS. 1 and 2, the straps 32,34 extend from the support frame 36, which is positioned against the user's hand 15, and wrap around the user's hand 15. The straps 32,34 may be constructed from any suitable material such as nylon, rubber (e.g. elastic band), woven or non-woven fabrics, etc. The support frame 36, from which the spacer 40 extends, is preferably shaped to fit snugly against the user's hand 15 and may have some attributes of a buckle with regard to its interconnection with the straps 32,34. In some embodiments, including that shown in FIGS. 1 and 2, the support frame 36 is made from rubber, but in other preferred embodiments, the support frame 36 may be made from plastic or metal. The spacer 40 may, in some embodiments, be integral with the support frame 36, while in other embodiments may be fastened to the support frame 36 via fastener, adhesive, or the like. The support frame 36 may also play an indirect role in positioning the crosspiece 20 properly because of the interrelationship between the spacer 40 and the support frame 36.

The strapping system 30 preferably provides at least some adjustability to account for hand shape and size, comfort, or the like. In some embodiments, the elasticity of the bands may provide adjustability. In some embodiments, buckles, clips, or the like may be provided for such purpose. In some embodiments, including that shown in FIGS. 1 and 2, the straps 32,34 may include mating sections or areas of hook and loop fasteners (i.e., VELCRO®) to permit the straps 32,34 to be adjusted to desired lengths. The straps 32,34 are fed through the support frame 36 where they may be adjusted. In the illustrated embodiment, the hook and loop areas on the straps 32,34 are used to attach the ends of the straps 32,34 back onto themselves, thereby creating a secure fit on the stringed instrument player's hand 15.

Figure 3:
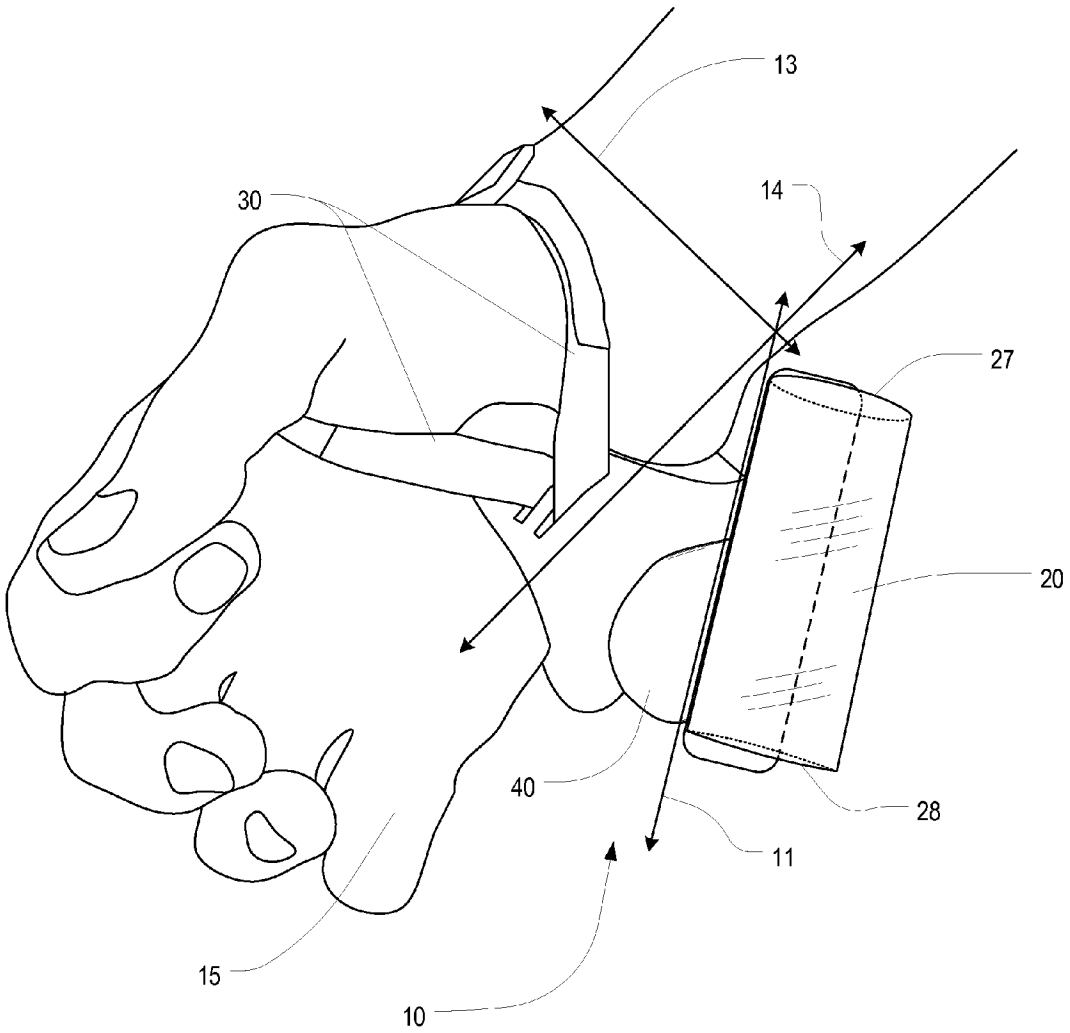
FIG. 3 is a front perspective view of the stringed instrument effects device of FIG. 1, illustrating the positioning of the device relative to the hand of the user.

FIG. 3 is a front perspective view of the stringed instrument effects device 10 of FIG. 1, illustrating the positioning of the device 10 relative to the hand 15 of the user 16. As shown therein, the user's wrist may be defined via line 13 and the outside of the user's palm may be defined via line 14, wherein the outside of the user's palm (line 14) is generally perpendicular to the user's wrist (line 13). The spacer 40 (in conjunction with the strapping system 30, including the support frame 36) positions the crosspiece 20 at an acute angle (represented by the angle between line 11 and line 14) relative to the outside of the user's palm, wherein a first end 27 of the crosspiece 20 is disposed adjacent the wrist 13 of the user's hand 15 and an opposite end 28 of the crosspiece 20 is adjacent to, but angled away from, the outside of the user's palm 14 (adjacent the user's little finger or "pinky"). The exact angle and/or position of the crosspiece 20 may, in some cases, be a matter of personal preference, but it is believed that some variation of the arrangement described and illustrated makes it possible for the user 16 to utilize the device 10 most effectively when playing a stringed instrument.

Figure 4:
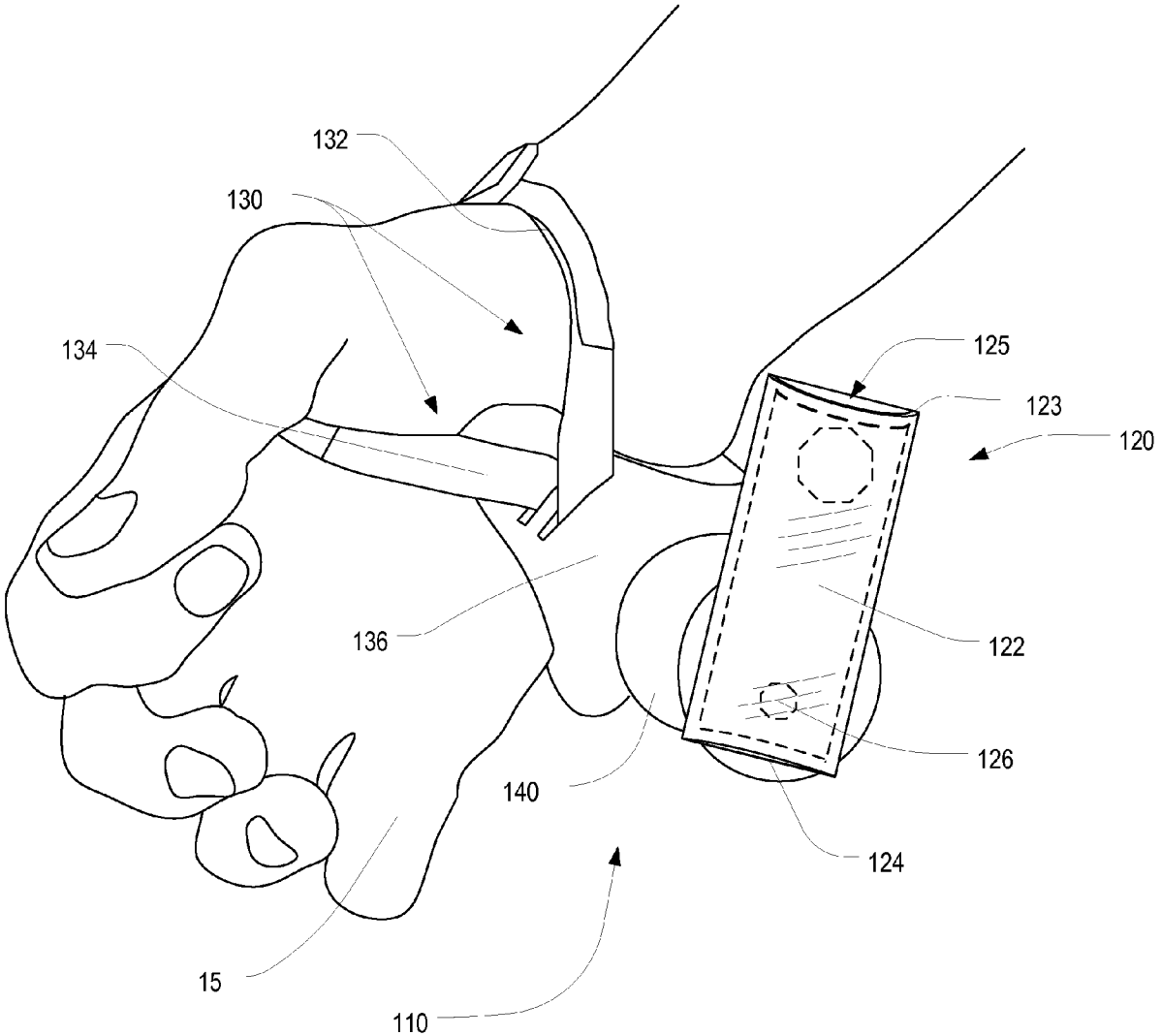
FIG. 4 is a front perspective view of a stringed instrument effects device in accordance with another preferred embodiment of the present invention.
Figure 5:
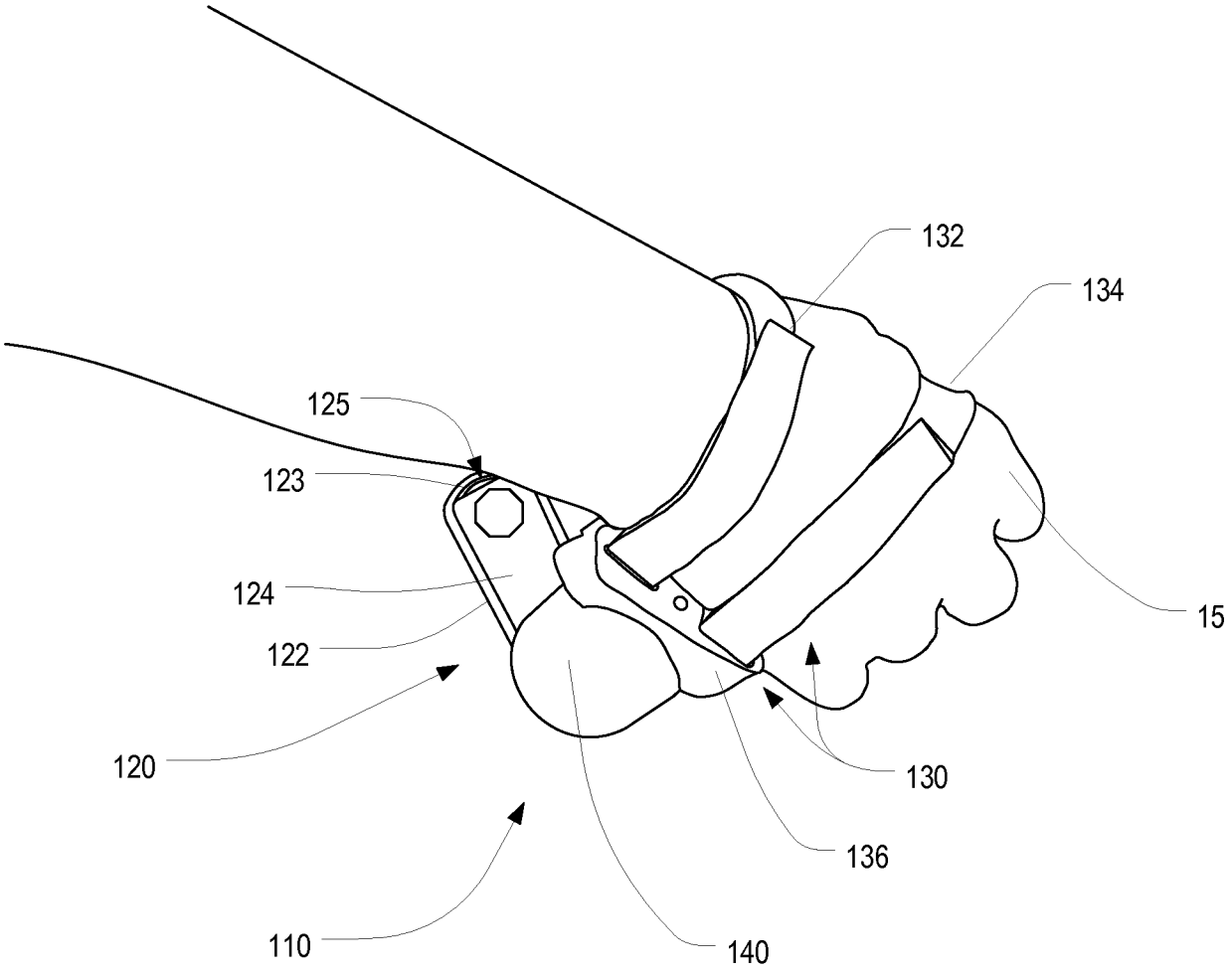
FIG. 5 is a back perspective view of the stringed instrument effects device of FIG. 4.

FIGS. 4 and 5 are a front perspective view and a back perspective view, respectively, of a stringed instrument effects device 110 in accordance with another preferred embodiment of the present invention. The effects device 110 of FIGS. 4 and 5 is somewhat similar to the effects device 10 of FIGS. 1 and 2, having a crosspiece 120, a strapping system 130, and a spacer 140. Moreover, the strapping system 130 and spacer 140 are at least somewhat similar to the strapping system 30 and spacer 40 of the effects device 10 of FIGS. 1 and 2.

However, the crosspiece 120 has a string interface 122 and a base member 124 that are somewhat different from the string interface 22 and base member 24 of the first embodiment. In particular, the crosspiece 120 in FIGS. 4 and 5 consists of a string interface 122 made from an arched or otherwise curved length of hard material. In various embodiments, the string interface 122 is between 1.5 and 3.5 inches in length and 0.5 to 3.0 inches in width. In at least one preferred embodiment, the string interface 22 is approximately 2 inches in length and approximately 1 inch in width.

In the illustrated embodiment, the string interface material is approximately 2 inches long and is made of hard plastic, but may be glass, metal, wood, or the like. In some embodiments, the string interface 122 may be semi-cylindrical. Like the base member 24 of FIGS. 1 and 2, the base member 124 of FIGS. 4 and 5 may be produced from a length of rubber, but may include frame structures 123 to better support the string interface 122 and to provide an additional surface for adhesive between the string interface 122 and base member 124. A chamber 125 is thus provided between the string interface 122 and base member 124 which may provide improved resonance characteristics.

The spacer 140 may be generally similar to the spacer 40 of FIGS. 1 and 2. The base member 124 may be secured to the spacer 140 via a fastener 126.

Figure 6:
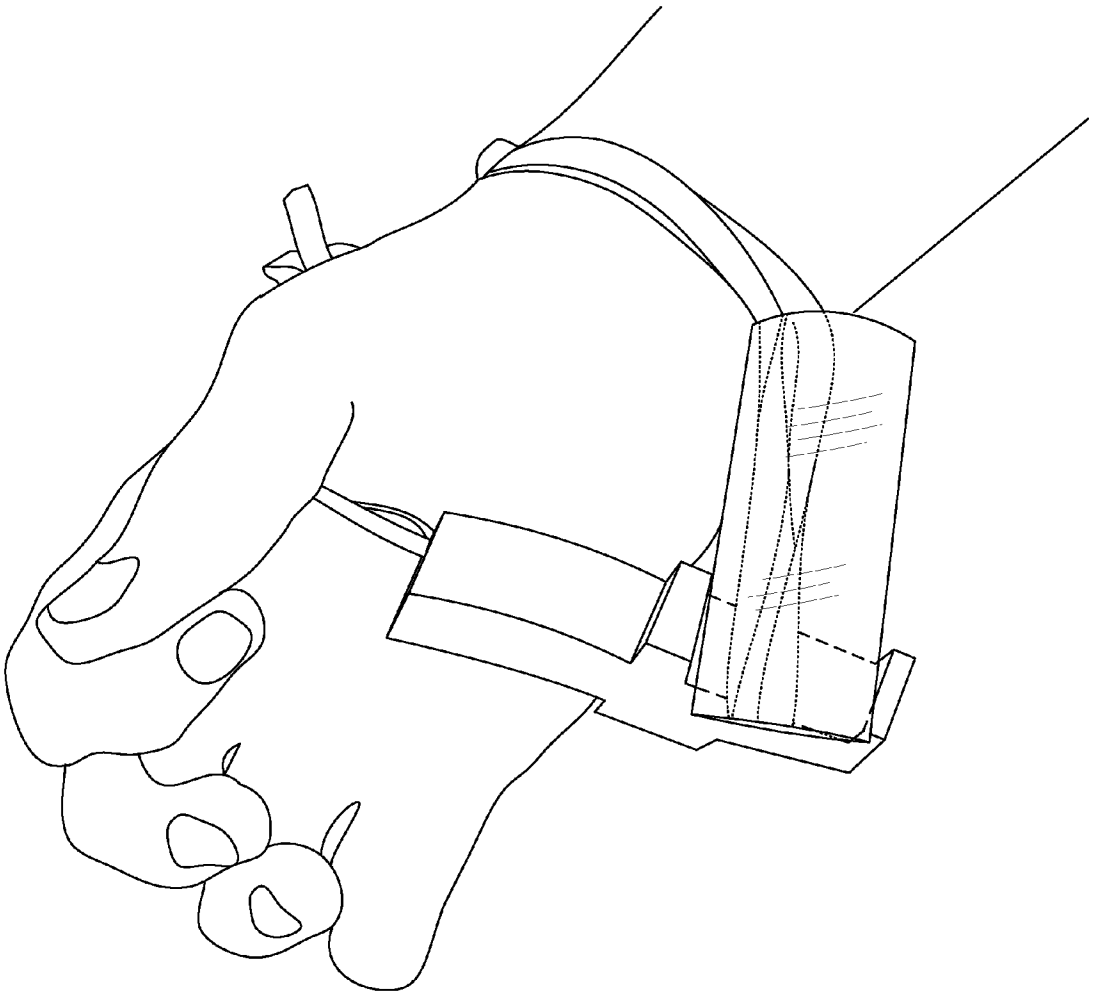
FIG. 6 is a front perspective view of a stringed instrument effects device in accordance with another preferred embodiment of the present invention.
Figure 7:
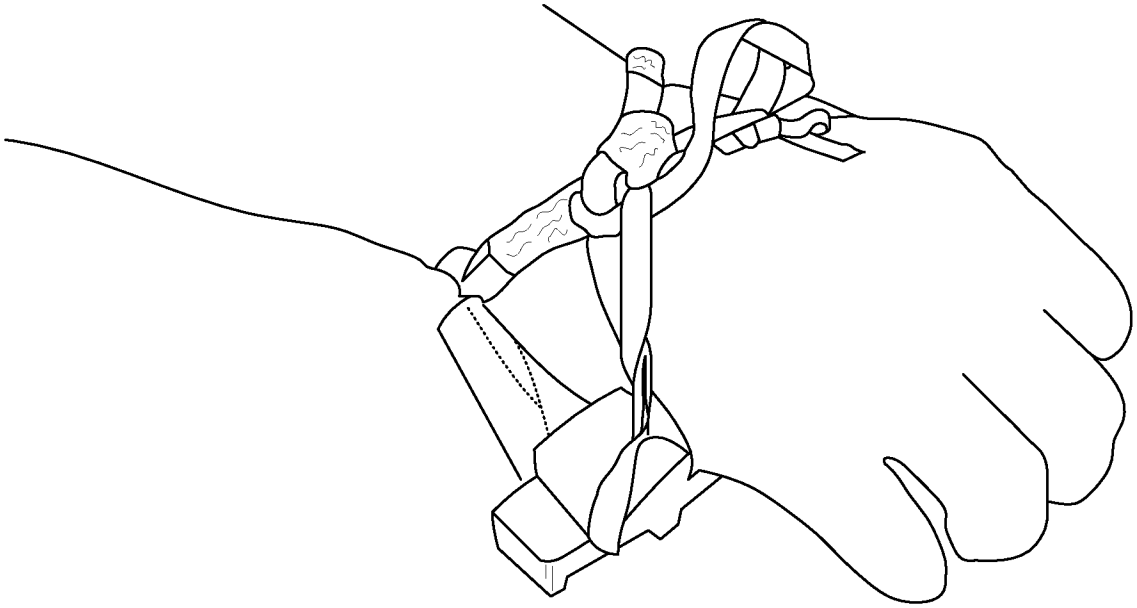
FIG. 7 is a back perspective view of the stringed instrument effects device of FIG. 6.

FIGS. 6 and 7 are a front perspective view and a back perspective view, respectively, of a stringed instrument effects device 210 in accordance with another preferred embodiment of the present invention. The effects device 210 of FIGS. 6 and 7 includes a crosspiece 220, a strapping system 230, and a spacer 240. The crosspiece 220 includes only a simple string interface 222 that may be similar to that of the string interface 22 of FIGS. 1 and 2. More particularly, the string interface 222 may be made from glass and in the shape of a hollow cylindrical tube, defining a chamber 225. In this embodiment, the spacer 240 is made from plastic and foam and includes an L-shaped palm section 236 that extends across a portion of the palm of the user's hand 15 and around the outside thereof, as well as two cradle portions 237,238 that retain the crosspiece 220 therein. The strapping system 230 includes a plurality of elastic bands 232,234 that are wrapped around the hand 15 and tied to secure them to the hand 15. One of the bands 232 is preferably connected directly to the spacer 240 while another band 234 is routed through the chamber 225 of the string interface 222 to hold the crosspiece 220 in place in the cradle portions 237,238 of the spacer 240.

Figure 8:
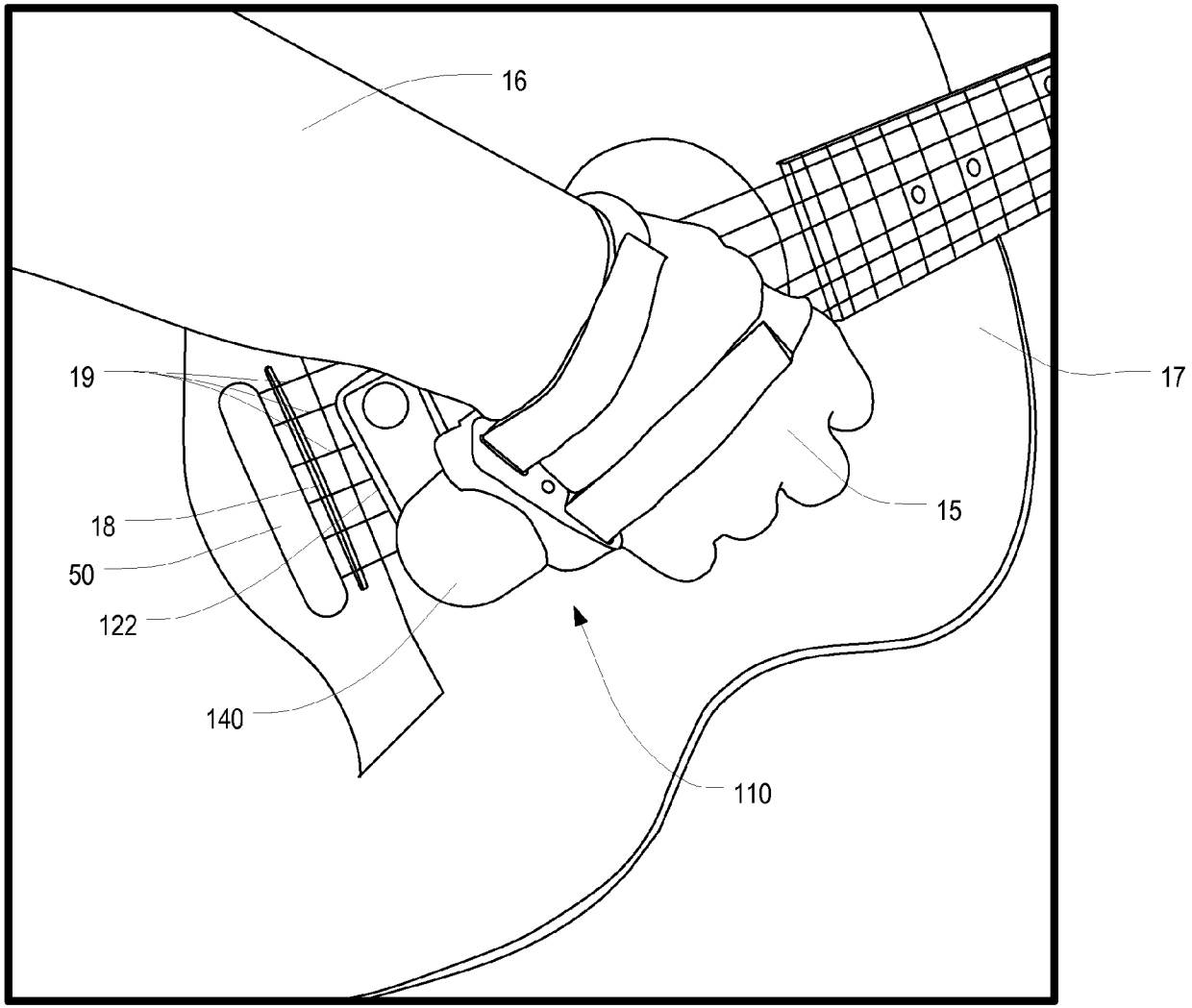
FIG. 8 is a perspective view of a stringed instrument player using the stringed instrument effects device described in FIGS. 4 and 5.

FIG. 8 is a perspective view of a stringed instrument player 16 using the stringed instrument effects device 110 described in FIGS. 4 and 5. The player 16 is holding a stringed instrument 17, in this case an acoustic guitar, and has the effects device 110 strapped to his picking hand 15 as described previously. The effects device 110 is positioned near the bridge 18 of the stringed instrument 17, using the spacer 140 to keep the string interface 122 approximately parallel to the bridge 18 (perpendicular or at least generally crosswise to the strings 19), the player 16 is able to place the string interface 122 across the strings 19 of the instrument 17. Other embodiments of a stringed instrument effects device 10,210 may be utilized in a generally similar manner.

Figure 9:
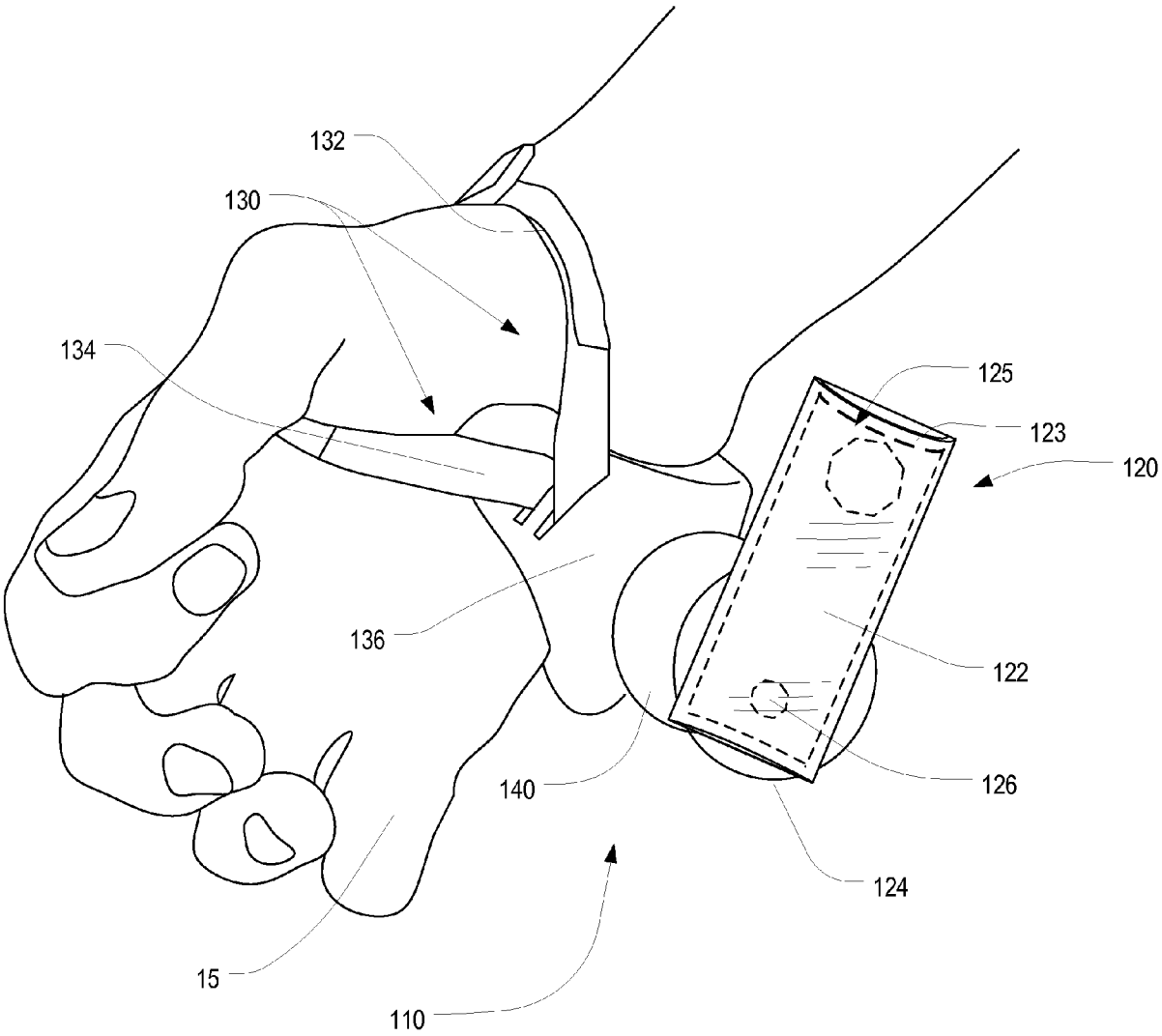
FIG. 9 is a front perspective view of the stringed instrument effects device of FIG. 4, illustrating the repositioning of the crosspiece using an adjustable spacer.

In at least some embodiments, further adjustability may be provided so as to allow a user to position and orient the crosspiece 120, including the string interface 122, as desired. In this regard, FIG. 9 is a front perspective view of the stringed instrument effects device 110 of FIG. 4, illustrating the repositioning of the crosspiece 120 using an adjustable spacer 140. The spacer 140 includes an adjustable joint or fitting, such as a ball and socket joint, to permit an upper portion 142 of the spacer 140 to be rotated relative to a lower portion 144. The crosspiece 120 is mounted to the upper portion 142, and thus is rotated with the upper portion 142 when it is adjusted. Such adjustment permits the angle of the crosspiece 120, and thus the string interface 122, relative to the user's hand 15. This is illustrated through a comparison of the position of the crosspiece 120 in FIG. 9 relative to the position of the crosspiece 120 in FIG. 4. In some embodiments (such as in the case of the ball and socket joint), adjustment may be provided in more than one axis or dimension, so the string interface 122 may be rotated relative to the hand 15 while more or less maintaining the angle of the string interface 122 relative to the outside of the hand 15.

Figure 10:
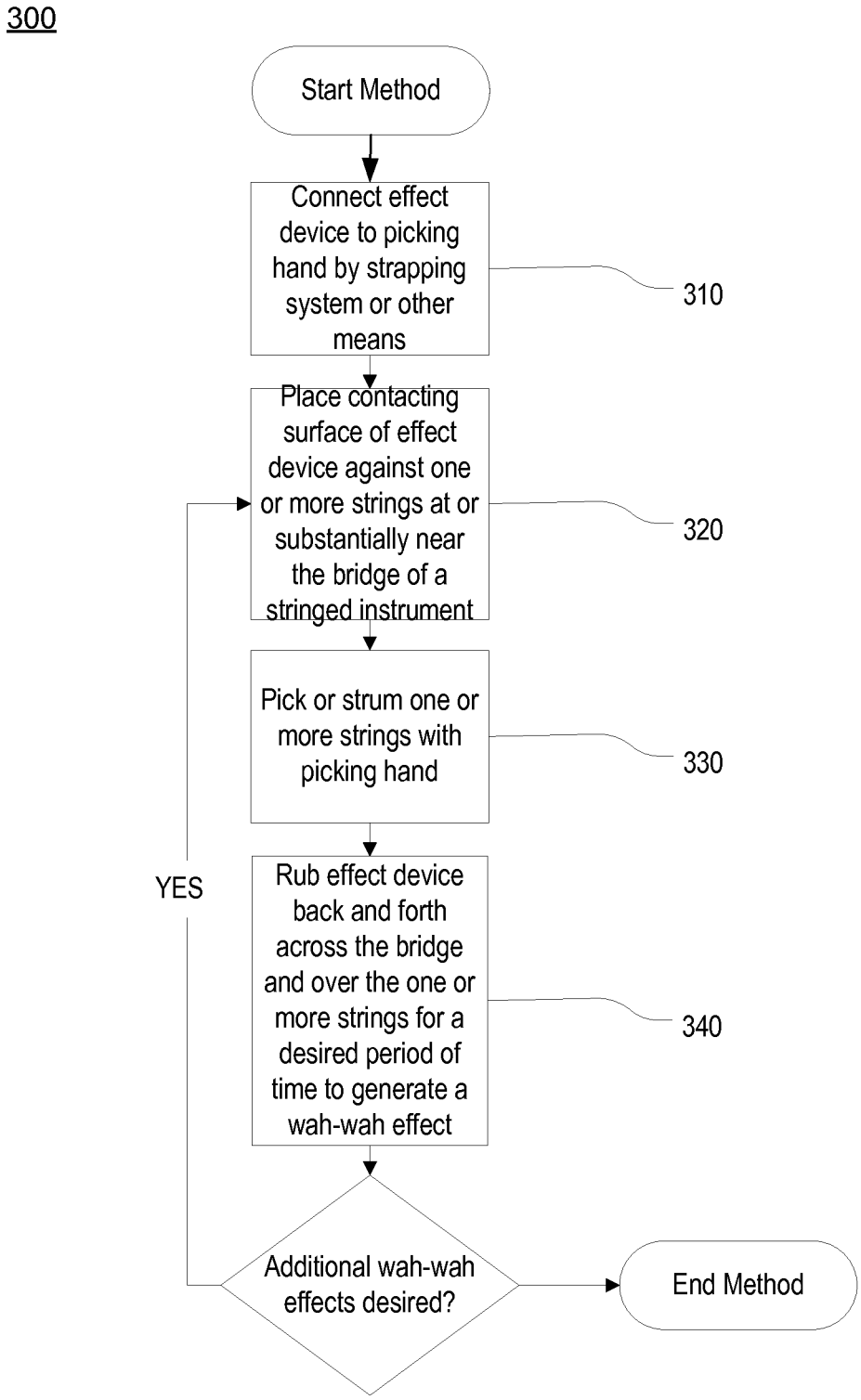
FIG. 10 is a flow chart showing an example of a method of producing a wah-wah effect using a stringed instrument effects device as described with regard to FIGS. 1-7.

FIG. 10 is a flow chart of an exemplary method 300 of producing a wah-wah sound effect using a stringed instrument effects device 10,110,210 as described with regard to FIGS. 1-7 and shown in FIG. 8. The method 300 starts with the player 16 connecting the effects device 10,110,210 to his picking hand 15 at step 310. Next, at step 320, the string interface 22,122,222 of the stringed instrument effects device 10,110,210 is placed against the strings of the instrument, near the bridge 18. The player 16 picks, strums, or otherwise activates one or more strings 19 with their picking hand 330. In conjunction with the picking or strumming, the player rubs the effects device 10,110,210 back and forth across the strings 19, as indicated at step 340, keeping the effects device 10,110, 210 generally parallel and close to the bridge 18 (generally crosswise to the strings 19). Notably, the player 16 may, as an alternative or adjunct to rubbing the device across the strings 19, slide the effects device 10,110,210 up and down the strings 19, with specific techniques being developed and honed by the particular player 19. Various sound effects, such as a "wah-wah" effect or "delay" effect, is created as the effects device 10,110,210 interacts with the strings 19 near the bridge 18. Each time the player 16 wants to add the desired sound effect, they can manipulate the effects device 10,110, 210 across the strings after they are picked or strummed, repeating the process in steps 320,330,340.

Notably, the sound effects themselves are created from a purely mechanical device with no electrical signal or power involved. However, it should be appreciated that an electrical microphone or other amplifying device may also be attached to the guitar 17 or hand 15 to amplify the sound of the effects device 10,110,210.

Figure 11:
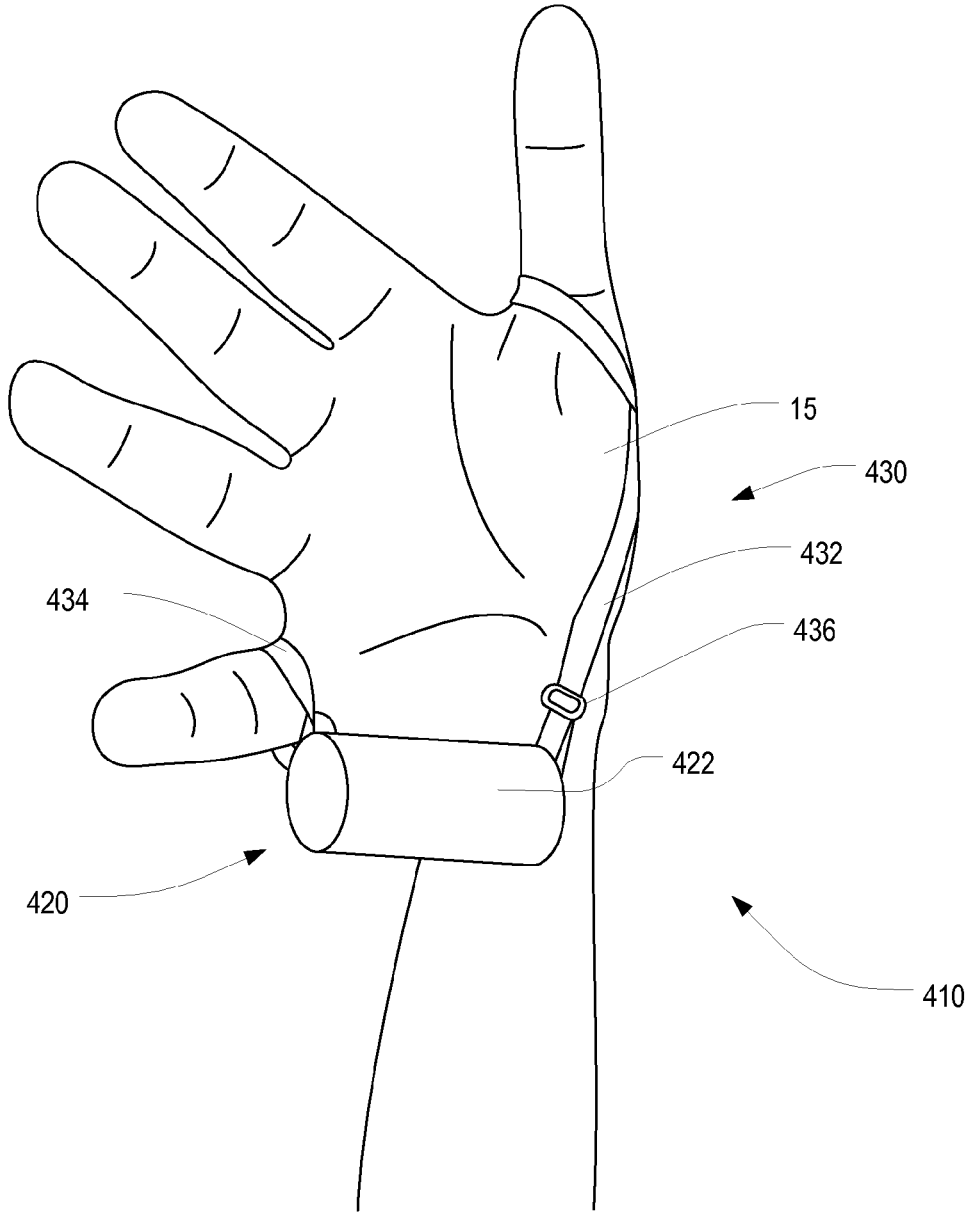
FIG. 11 is front perspective view of a stringed instrument effects device in accordance with another preferred embodiment of the present invention.

FIG. 11 is front perspective view of a stringed instrument effects device 410 in accordance with another preferred embodiment of the present invention. Like the effects device 10 of FIGS. 1 and 2, the effects device 410 of FIG. 11 includes a crosspiece 420 and a strapping system 430. The strapping system 430 is simpler than that of FIGS. 1 and 2, however, and includes only slender straps 432,434 and one or more buckle 436. The crosspiece 420 has a string interface 422 in the form of a solid or filled cylinder.

Figure 12:
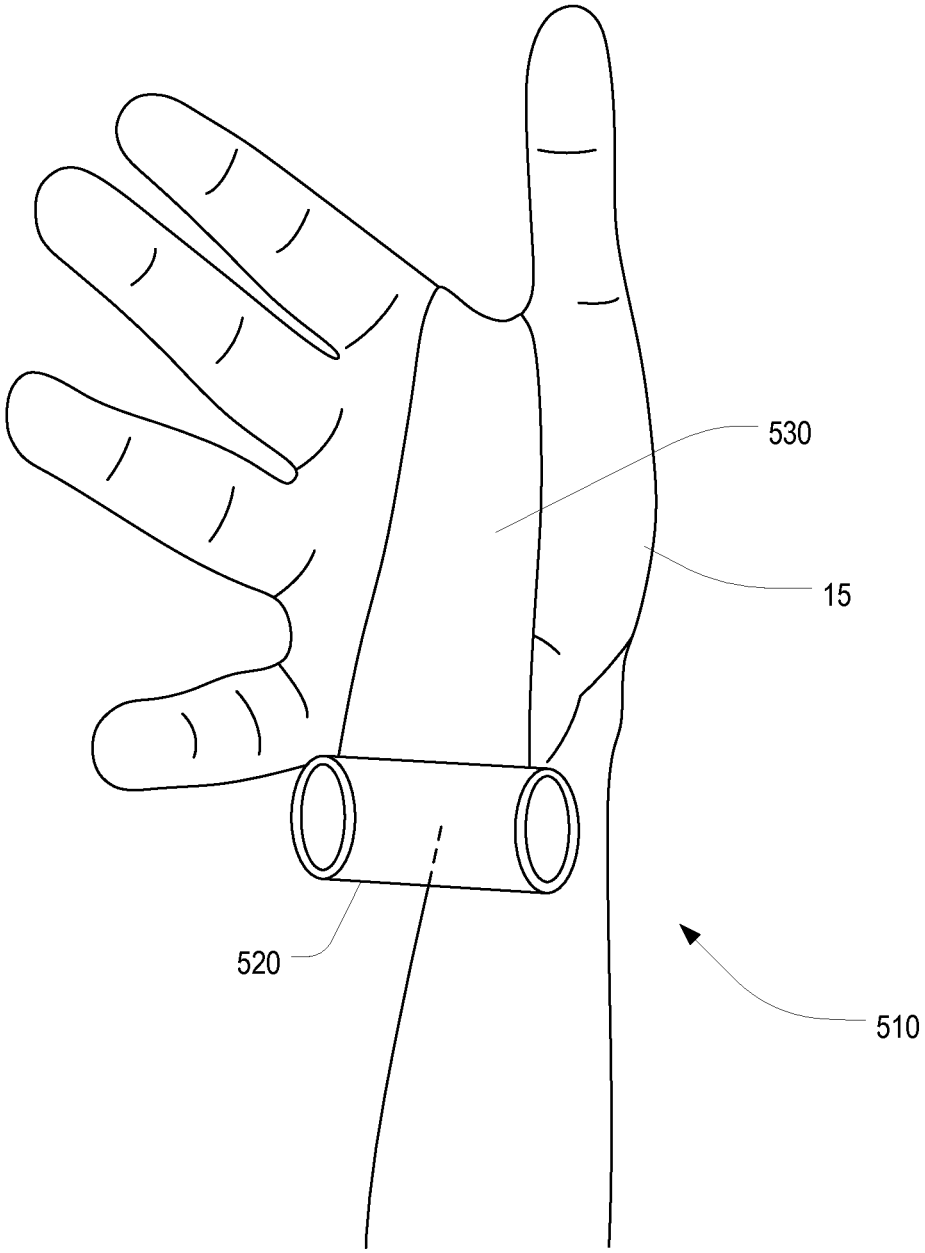
FIG. 12 is a front perspective view of a stringed instrument effects device in accordance with another preferred embodiment of the present invention.

FIG. 12 is a front perspective view of a stringed instrument effects device 510 in accordance with another preferred embodiment of the present invention. Like the effects device 10 of FIGS. 1 and 2, the effects device 510 of FIG. 12 includes a crosspiece 520 and a strapping system 530. The strapping system 530 is an example of another embodiment with where a wide connection band is used to connect the crosspiece 520 to the hand 15.

Figure 13:
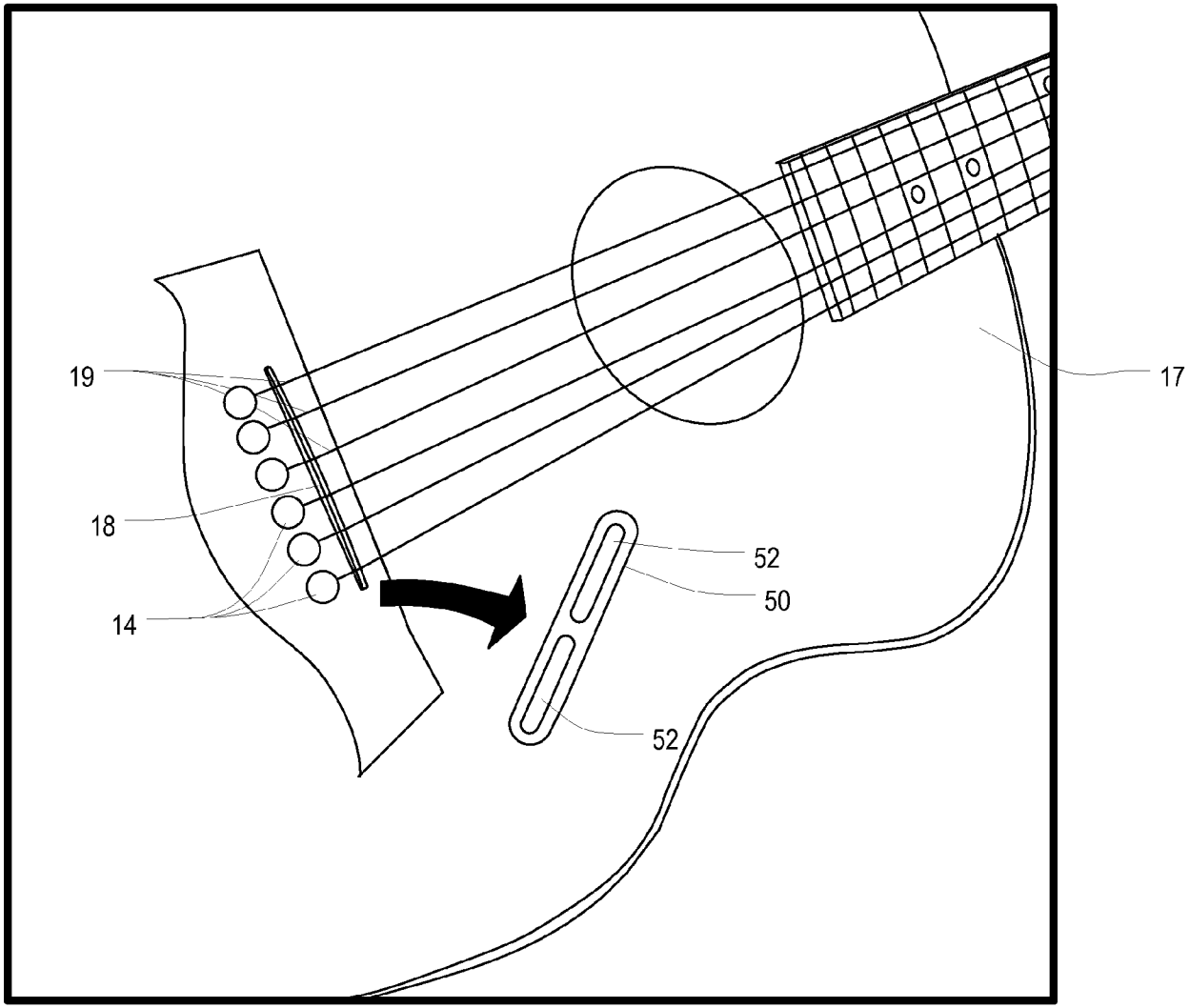
FIG. 13 is a perspective view of the guitar of FIG. 8, illustrating the use of an exemplary noise prevention device in accordance with one or more preferred embodiments of the present invention.

Due to the position of the stringed instrument effects devices described herein when in use (i.e., while playing an instrument), and the motion of such devices while in use, it may be useful to include various noise prevention or reduction devices as accessories therefor. In this regard, FIG. 13 is a perspective view of the guitar 17 of FIG. 8, illustrating the use of an exemplary noise prevention device 50 in accordance with one or more preferred embodiments of the present invention. It will be appreciated that many acoustic guitars 17 utilize bridge pins 14 to retain the strings 19. Such bridge pins 14 are illustrated in FIG. 8. Unfortunately, while utilizing stringed instrument effects devices described herein, the player may have a tendency to bump the hard surfaces of the bridge pins 14, thus making "clicking" or "knocking" noises that may not be desired. To alleviate this, a noise reduction or prevention device 50 may be provided as part of any of the stringed instrument effects devices described herein, or as an accessory to any of the stringed instrument effects devices described herein. The noise reduction or prevention device 50 is a length of silicone foam or other soft material that includes one or more slot 52 in the bottom thereof to fit over one or more of the bridge pins 14. In FIG. 8, the noise reduction or prevention device 50 is shown removed from the bridge pins 14 and flipped over to show the underside thereof (including the two slots 52), while in FIG. 8 the noise reduction or prevention device 50 is shown installed on the bridge pins 14. The material used is preferably elastic enough to be stretched over the bridge pins 14 but to retract and remain in place over the pins 14 once installed.

In various alternative embodiments, a string interface may be a solid or substantially solid piece of material. Also in various alternative embodiments, a string interface may be round, oval, square, rectangular, hexagonal, or any suitable shape.

Based on the foregoing information, it will be readily understood by those persons skilled in the art, that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention.

Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements; the present invention being limited only by the claims appended hereto and the equivalents thereof.

What is claimed is:

1. A non-electrical stringed instrument sound effects device, comprising:

a crosspiece, including a string interface, that is configured to be placed against one or more strings of a stringed musical instrument; and a strapping system that is configured to removably fasten the crosspiece, including the string interface, around all or a portion of a plucking or strumming hand of a player of the stringed musical instrument; wherein the strapping system includes a support frame, wherein the support frame has a shape arranged to mold to the palm of the plucking or strumming hand of the player.

2. The non-electrical stringed instrument sound effects device of claim 1, further comprising a spacer which, in conjunction with the strapping system, is configured to displace the crosspiece away from the plucking or strumming hand of the player.

3. The non-electrical stringed instrument sound effects device of claim 2, wherein the spacer, in conjunction with the strapping system, is configured to position the crosspiece such that a first end of the crosspiece is adjacent the wrist of the plucking or strumming hand of the player and a second end of the crosspiece is displaced away from an outside of the palm of the plucking or strumming hand of the player such that an acute angle is formed between an orientation of the crosspiece and a line defined by the outside of the palm of the plucking or strumming hand of the player.

4. The non-electrical stringed instrument sound effects device of claim 2, wherein the spacer is carried by the support frame.

5. The non-electrical stringed instrument sound effects device of claim 2, wherein a chamber is at least partially defined by the string interface.

6. The non-electrical stringed instrument sound effects device of claim 2, wherein the spacer includes a first portion and a second portion, wherein the second portion is adjustable relative to the first portion, wherein the first portion is connected to the strapping system, and wherein the crosspiece is connected to the second portion such that the crosspiece may be adjusted relative to the first portion of the spacer and thus relative to the strapping system.

7. The non-electrical stringed instrument sound effects device of claim 6, wherein the second portion of the spacer is rotatable relative to the first portion of the spacer via a ball and socket joint.

8. The non-electrical stringed instrument sound effects device of claim 1, wherein the crosspiece further includes a base member that supports the string interface.

9. The non-electrical stringed instrument sound effects device of claim 1, wherein the strapping system includes a first portion configured to extend around at least a portion of the wrist of the plucking or strumming hand of the player and a second portion configured to extend across at least a portion of the palm of the plucking or strumming hand of the player.

10. The non-electrical stringed instrument sound effects device of claim 9, wherein the first portion of the strapping system is a first adjustable strap and the second portion of the strapping system is a second adjustable strap.

11. The non-electrical stringed instrument sound effects device of claim 1, wherein the string interface is made from an arched or otherwise curved length of hard material.

12. The non-electrical stringed instrument sound effects device of claim 11, wherein the arched or otherwise curved shape of the string interface at least partially defines a chamber.

13. The non-electrical stringed instrument sound effects device of claim 11, wherein the string interface is made from a cylindrical length of hard material.

14. The non-electrical stringed instrument sound effects device of claim 11, wherein the crosspiece is connected at one end thereof to the spacer.

15. The non-electrical stringed instrument sound effects device of claim 1, further comprising a noise reduction or prevention device that removably covers bridge pins of the stringed musical instrument.

16. The non-electrical stringed instrument sound effects device of claim 15, wherein the noise reduction or prevention device is a length of foam that includes slots on its underside to cover and wrap the bridge pins.

17. A method of creating a sound effect while plucking or strumming a stringed musical instrument, the method comprising:

providing a non-electrical sound effects device, the device including a crosspiece and a strapping system, the strapping system including a support frame, and the crosspiece having a string interface;

attaching the sound effects device to a plucking or strumming hand of a player of a stringed musical instrument such that the strapping system extends around all or a portion of the plucking or strumming hand wherein the support frame has a shape arranged to mold to the palm of the plucking or strumming hand of the player, and the crosspiece is disposed adjacent an outside of the plucking or strumming hand;

by the player, positioning the plucking or strumming hand in a conventional playing position adjacent strings of the stringed musical instrument such that the string interface of the crosspiece extends across at least one of the strings; and during an action, by the player, of plucking or strumming the at least one string, manipulating the string interface of the crosspiece, by the player, against the at least one string to achieve a desired sound effect without use of electrical power.

18. The method of claim 17, wherein the device further includes a spacer, wherein the step of attaching the sound effects device includes attaching the sound effects device to the plucking or strumming hand of the player such that the spacer displaces the crosspiece away from the plucking or strumming hand.

19. The method of claim 18, wherein the step of attaching the sound effects device includes attaching the sound effects device to the plucking or strumming hand of the player such that a first end of the crosspiece is adjacent the wrist of the plucking or strumming hand of the player and a second end of the crosspiece is displaced away from an outside of the palm of the plucking or strumming hand of the player such that an acute angle is formed between an orientation of the crosspiece and a line defined by the outside of the palm of the plucking or strumming hand of the player.

20. The method of claim 17, wherein the strapping system includes a first portion and a second portion, and wherein the step of attaching the sound effects device includes extending the first portion around at least a portion of the wrist of the plucking or strumming hand of the player and extending the second portion across at least a portion of the palm of the plucking or strumming hand of the player.

21. The method of claim 20, wherein the first portion of the strapping system is a first adjustable strap and the second portion of the strapping system is a second adjustable strap.

22. The method of claim 17, wherein the string interface is made from an arched or otherwise curved length of hard material.

23. The method of claim 22, wherein the arched or otherwise curved shape of the string interface at least partially defines a chamber.

24. The method of claim 22, wherein the string interface is made from a cylindrical length of hard material.

25. The method of claim 17, wherein the step of positioning the plucking or strumming hand includes positioning the plucking or strumming hand such that the string interface of the crosspiece extends across at least one of the strings adjacent a bridge of the stringed musical instrument.

26. The method of claim 17, wherein the step of manipulating the string interface of the crosspiece, by the player, includes contacting the at least one string while simultaneously plucking or strumming the at least one string.

27. The method of claim 17, wherein the step of manipulating the string interface of the crosspiece, by the player, includes contacting the at least one string non-simultaneously with, but shortly after, plucking or strumming the at least one string.

28. The method of claim 17, wherein the step of manipulating the string interface of the crosspiece, by the player, includes rubbing or sliding the string interface against or along the at least one string.

29. The method of claim 17, wherein the step of manipulating the string interface of the crosspiece, by the player, includes creating a wah-wah or delay sound effect.

30. A musical instrument, having a non-electrical stringed instrument sound effects device, comprising:

a conventional stringed instrument, held by a player such that a first hand, defining a picking or strumming hand, is positioned adjacent a soundboard of the stringed instrument and a second hand, defining a tuning hand, is positioned adjacent a neck of the stringed instrument; and a non-electrical sound effects device attached to the picking or strumming hand of the player, the device including:

a crosspiece, with a string interface that at least partially defines a chamber, that is placed against one or more strings of the stringed instrument, a spacer that positions the crosspiece away from an outside of the palm of the plucking or strumming hand, and a strapping system that holds the crosspiece and spacer on the picking or strumming hand; wherein the strapping system includes a support frame, wherein the support frame has a shape arranged to mold to the palm of the plucking or strumming hand of the player.

31. The musical instrument of claim 30, further comprising a noise reduction or prevention device that removably covers bridge pins of the stringed instrument.

* * * * *